US005560082A

United States Patent [19]

Vetter

[11] Patent Number: 5,560,082

[45] Date of Patent: Oct. 1, 1996

[54] FOLDING WINDOW OPERATOR HANDLE

[75] Inventor: Gregory J. Vetter, Owatonna, Minn.

[73] Assignee: Truth Hardware Corporation, Owatonna, Minn.

[21] Appl. No.: 306,719

[22] Filed: Sep. 15, 1994

[51] Int. Cl.[6] ..... B25G 1/04

[52] U.S. Cl. ..... 16/115; 74/557; 74/528; 74/543; 74/545

[58] Field of Search ..... 16/110 R, 115, 16/DIG. 30, 112; 74/557, 528, 543, 545

[56] References Cited

U.S. PATENT DOCUMENTS

| | | | |
|---|---|---|---|
| Re. 34,230 | 4/1993 | Tucker et al. . | |
| 3,007,348 | 11/1961 | Barnes | 74/545 |
| 4,162,805 | 7/1979 | Hirschberger | 74/545 |
| 4,390,203 | 6/1983 | Lutz et al. | 74/545 |
| 4,617,758 | 10/1986 | Vetter . | |
| 4,937,976 | 7/1990 | Tucker et al. . | |
| 5,152,103 | 10/1992 | Tucker et al. . | |
| 5,400,473 | 3/1995 | Delman | 16/115 |
| 5,410,778 | 5/1995 | Langevin | 16/115 |

OTHER PUBLICATIONS

Illustration of Truth/Marvin Handle.
Illustration of Ellis/Indutec Alchemist Handle.

*Primary Examiner*—Chuck Y. Mah
*Attorney, Agent, or Firm*—Wood, Phillips, VanSanten, Clark & Mortimer

[57] ABSTRACT

A window operator handle foldable between an operable position for manual pivoting and a storage position, including a body with a manually graspable portion at one end and a recess in the other end, and a base including a longitudinal cylindrical portion having a central bore extending completely through the base. The handle body recess is defined by side walls spaced a selected width, a top wall, and a wall at one end oriented substantially parallel to the operator drive shaft when the handle is in the operable position, with the base cylindrical portion having an outer diameter slightly less than the selected width. An operator drive shaft is securable in the base bore so that the an outer end of the drive shaft is substantially adjacent the handle body when the handle is in a storage position. The handle base is secured for pivoting relative to the handle body about an axis substantially orthogonal to longitudinal whereby in the storage position the base is substantially within the handle body recess. The body top wall serves as a stop for pivoting of the base relative to the body when the handle is pivoted to the storage position and the body end wall serves as a stop for pivoting of the base relative to the body when the handle is pivoted to the operable position. A detent on the handle base is sharply tapered at one end, with the detent itself being narrower than the recess selected width by a selected amount. A detent spring has two legs connected at one end by a spring base secured at the other end of the handle body. In an unbiased position, the other ends of the spring legs are spaced apart less than the width of the detent, with those leg ends having a total width which is less than the selected amount and engaging the detent tapered end when the handle is in the operable position.

8 Claims, 1 Drawing Sheet

FOLDING WINDOW OPERATOR HANDLE

BACKGROUND OF THE INVENTION

1. Technical Field

The present invention is directed toward handles, and more particularly toward handles for use with window operators.

2. Background Art

Window operators are well known in the art for controlling positioning of a window sash relative to a window frame. While many such operators can be motor driven, typically such operators are manually controlled and driven by pivoting of a handle connected to the operator drive shaft.

It has been heretofore found that a good orientation of the operator drive shaft is approximately 35 degrees to horizontal. Still further, it has been found to be preferable to configure the handle so that the manually grasped end of it (typically having a knob thereon) is spaced outwardly from the operator and its cover, which spacing helps to ensure adequate room so that the person pivoting the handle will not risk banging his/her knuckles on the sash, the window pane, or the window frame or sill adjacent the sash during pivoting. Of course, such banging of the knuckles can not only hurt the person, but can also mark or soil the areas of the window being contacted. Further, particularly in connection with the glass pane in the sash, such banging of the person's knuckles presents some risk of breakage which would not only damage the window but also create a serious danger to the person.

Unfortunately, the above described need to project the handle outwardly from the operator and its cover makes the handle more susceptible to being accidentally bumped by a person having no intent to use the operator. A person who accidentally bumps the handle could damage or even break the handle. At a minimum, such bumping can cause the handle to be soiled and/or scratched, and thereby result in an aesthetic eyesore at the edge of an area (the window) typically intended to attract visual attention. The person might also himself/herself be bruised or hurt from bumping into the handle. Still further, bumping of the handle could also result in some turning of the handle, with natural resulting movement of the window. While such movement might be slight, only slight movement of the window is required to break the weather seal of a closed window, with a resultant unrecognized significant loss of energy around the sash.

Unrecognized pivoting of an operator handle as a result of accidental bumping is also particularly undesirable in installations where pivoting of the operator handle controls not only movement of the window sash but also the condition of the window lock. (That is, some window operators, such as those shown in U.S. Pat. Nos. 4,617,758, 4,937,976, 5,054,239 (Re. 34,230) and 5,152,103, unify the lock and operator function so that initial pivoting of the handle with a closed window unlocks the window locks and subsequent pivoting causes the window sash to open.) Obviously, accidental bumping of handles in such unified operators could result in a window being unknowingly unlocked and thereby dangerously susceptible to forced entry.

In order to address these problems, some operators have been provided with handles which can be folded to a storage position against the operator cover. Further, some operators have been specially adapted to use such folding of the handle in their functioning (for example, U.S. Pat. No. 4,937,976). While such prior art handles have addressed some of the above mentioned problems, they can introduce new problems.

For one, such folding handles must be adequately secured in whichever position is desired. For example, if the handle is not securely maintained in its storage position when not in use, it might be moved to the operable position, whether by gravity or bumping or some other force, and therefore fail to meet the purpose of its folding feature. Conversely, if the handle is not securely maintained in its operable position when being pivoted by a person, there is a risk that the handle would fold down during pivoting. If that were to unexpectedly occur, the user might very well bang their hand against the window and hurt either or both.

Of course, the need to adequately secure such handles conflicts with the requirement, for ease of use, that the handle also be easily movable between such positions. Folding the handle from one secure position to another might not, as a practical matter, be done if doing so is difficult. That is, a person might consciously choose not to bother with folding the handle if it is too difficult. Further, if such folding is too difficult, the person using the window might not even recognize that it can be done and therefore either unknowingly leave the handle in the operable position or even try to operate the handle when in its storage position.

Still further, it is highly desirable that such handles be sturdy enough so that they can not only provide reliable service over numerous years, but also adequately transmit the sometimes high forces required in window operation (particularly when closing the sash against, or opening it from, the weather seal around the frame). However, since it is a primary object of windows to provide an aesthetically pleasing appearance and an open feel to the room, it is also desirable that the visible window operator components (the handle being perhaps the most prominent) be themselves aesthetically pleasing while at the same time minimally intruding on the open feel provided by an open window and/or the glass when closed. Simply put, a window should draw a person's attention to the opening therethrough, not to the operator components located along the side of the window. Thus, the design of folding handles requires a difficult balancing of their strength and durability needs with the desire for a compact and attractive appearance.

The present invention is directed toward overcoming one or more of the problems set forth above.

SUMMARY OF THE INVENTION

In one aspect of the present invention, a handle is provided for selectively manually pivoting a window operator drive shaft, the handle being foldable between an operable position for manual pivoting and a storage position. The handle includes a body with a manually graspable portion at one end and a recess in the other end, and a base including a longitudinal cylindrical portion having a central bore extending completely through the base. The drive shaft is securable in the base bore so that the outer end of the drive shaft is substantially adjacent the handle body when the handle is in a storage position. The handle base is secured for pivoting relative to the handle body about an axis substantially orthogonal to longitudinal whereby in the storage position the base is substantially within the handle body recess. A detent releasably secures the handle base relative to the handle body when the handle is in either its operable position or its storage position.

In another aspect of the present invention, the handle body recess is defined by side walls spaced a selected width, a top wall, and a wall at one end oriented substantially parallel to the operator drive shaft when the handle is in the operable position, with the base cylindrical portion having an outer diameter slightly less than the selected width. The body top wall serves as a stop for pivoting of the base relative to the body when the handle is pivoted to the storage position and the body end wall serves as a stop for pivoting of the base relative to the body when the handle is pivoted to the operable position.

In still another aspect of the present invention, the detent includes a detent portion on the handle base and a detent spring fixed to the handle body. The detent portion includes a tapered end and is narrower than the recess selected width by a selected amount. The detent spring has two legs connected at one end by a spring base and in an unbiased position spaced apart at their other ends less than the width of the detent tapered end. The other ends of the legs also have a total width which is less than the selected amount and engage the detent tapered end when the handle is in the operable position.

It is an object of the present invention to provide a handle for a window operator which is strong and will be durable over many years of use.

It is another object of the present invention to provide a window operator handle which is easy and simple to use.

It is still another object of the present invention to protect against unrecognized accidental or inadvertent opening and/or unlocking of the window.

It is yet another object of the present invention to provide a handle for a window operator having minimum susceptibility to damage.

Still another object of the present invention is to provide a window operator handle which is aesthetically pleasing while also providing minimal visual intrusion on the window opening with which it is used.

DESCRIPTION OF THE PREFERRED EMBODIMENT

Figure 1:
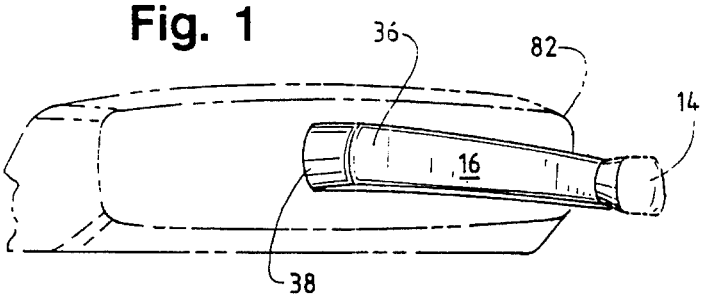
FIG. 1 is a perspective view of the handle of the present invention in its storage position relative to an operator cover shown in phantom.
Figure 3:
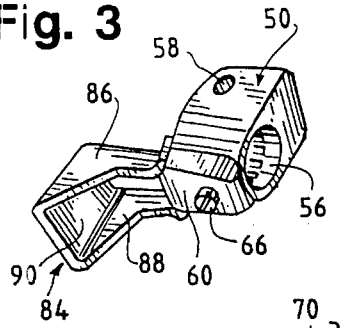
FIG. 3 is a detailed perspective view showing the handle base and the detent spring.

The handle 10 of the present invention is shown in FIG. 1 in a storage position, with the orientation of the handle 10 when in an operable position (for pivoting to manipulate a window operator, not shown).

Figure 2:
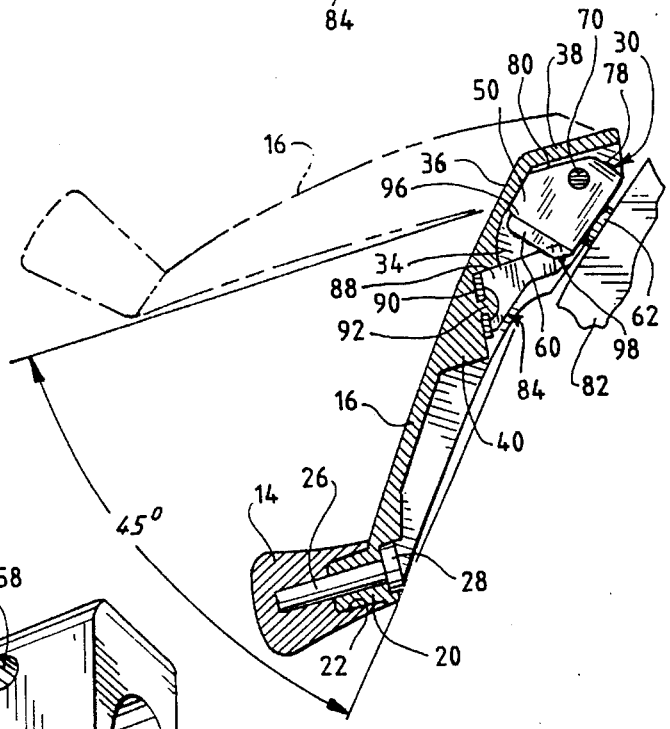
FIG. 2 is a cross-sectional view of the handle of the present invention, with the handle also shown in phantom in an operable position.

The handle 10 includes a knob 14 pivotally secured to the proximal end of a handle body 16. As best seen in FIG. 2, in the preferred embodiment the handle body 16 includes a cylindrical portion 20 received in a cylindrical recess 22 in the knob 14, there preferably being a clearance fit therebetween for easy pivoting. A pin 26 with an enlarged head 28 extends through a bore in the body cylindrical portion 20 and is suitably secured, as by a press fit connection, in a bore in the knob 14.

Figure 4:
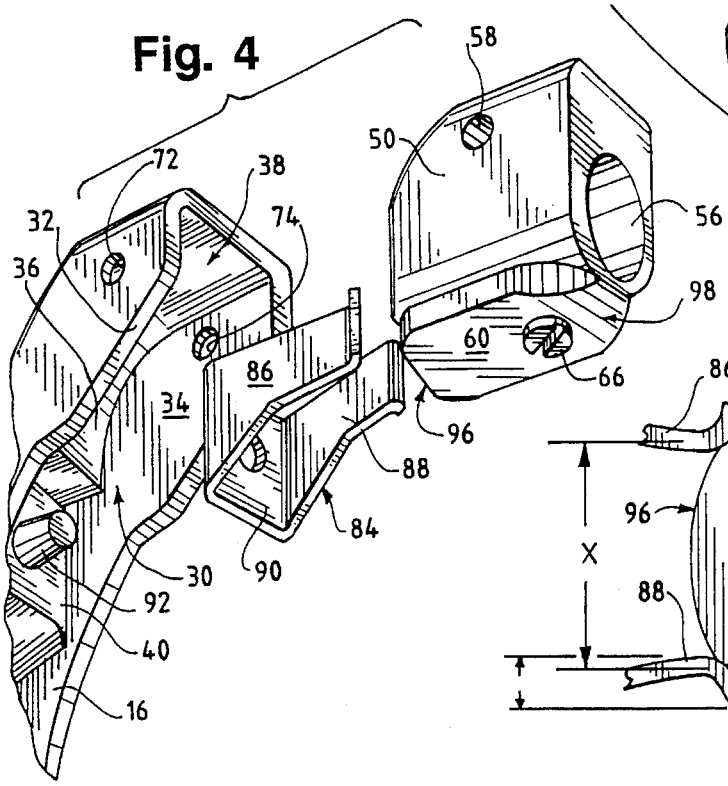
FIG. 4 is an exploded view of one end of the handle showing the handle body, detent spring, and handle base.

The distal end of the handle body 16 includes a recess 30 on its underside (i.e., the side facing down or toward the window operator). As perhaps best seen in FIG. 4, the recess is defined by spaced side walls 32, 34, a top wall 36 connecting the side walls 32, 34, and an end wall 38. A tapered solid portion 40 at the other end of the recess 30 defines a spring base 40 (as discussed in greater detail hereafter) and also adds strength and rigidity to the handle body 16.

A handle base 50 is pivotally secured, as described below, to the handle body 16. More particularly, the base 50, which is preferably made of a strong plastic material such as nylon 6/6 with 60% glass and ceramic fibers, includes a central portion with a drive shaft bore 56 extending completely therethrough, with a pivot bore 58 extending through a portion on one side of the drive shaft bore 56 (the two bores 56, 58 being substantially orthogonal to one another) and a detent 60 on the other side of the drive shaft bore 56.

The drive shaft bore 56 is preferably splined so that, as is conventional, a drive shaft of a window operator can be disposed therein whereby the splines of each will engage to secure the base 50 and an operator drive shaft 62 (see FIG. 2) together for operational pivoting. A set screw 66 is also preferably provided through the detent side of the base 50, which screw 66 can be easily accessed and turned to engage the drive shaft 62 and secure it in the shaft bore 56 in a manner which is well known in this art (or alternatively turned to release the drive shaft 62 to allow removal of the handle 10).

It should be appreciated that the side orientation of the pivot bore 58 together with the full extension of the drive shaft bore 56 through the base 50 allows the base 50, and thereby the entire handle 10, to be of minimal size. Further, the width of the base 50 can be minimized so that it need be no greater than the diameter of the shaft bore 56 plus the width of material which will provide suitable strength between the pivot bore and detent sides. The handle 10 can thus be non-intrusive (and therefore minimally susceptible to bumping and/or damage) and also given a trim, non-visually intrusive appearance as is desired in most installations.

A suitable pivot pin 70 (see FIG. 2) extends through the pivot bore 58 and through pivot openings 72, 74 on the opposite side walls 32, 34. The pivot pin 70 should be suitably secured in position allowing pivoting between the base 50 and body 16 as by, for example, press fit connections between the pin ends and the wall pivot openings 72, 74, or by some other suitable manner such as circumferentially grooving the pin 70 and securing a spring in that groove between the body 16 and the base 50 to axially hold the pin 70 in such position.

The side of the base 50 through which the pivot bore 58 extends includes an end surface 78 and a tapered surface 80. As best seen in FIG. 2, the end surface 78 is oriented substantially parallel to the shaft bore 56 so that, when the handle body 16 is pivoted to its operable position (shown in phantom in FIG. 2) the recess end wall 38 abuts the end surface 78 to form a stop against further pivoting about the pivot pin 70. Similarly, the top of the base 50 will engage the top wall 36 to form a stop against pivoting beyond the desired body 16 orientation in the storage position. The tapered surface 80 is oriented so that it will provide clearance from the body walls 36,38 through the range of pivoting of the body 16 to allow pivoting between the operable and storage positions. (Note that the handle 10 is, in FIGS. 1 and 2, shown in a preferred substantially horizontal storage position lying generally against and along the width of the housing 82. Of course, depending upon the installation, the storage position could alternatively be at an angle relative to the width of the housing 82, the important feature being that the pivoting of the handle 10 reduce its extension into the room when not being used to provide the protection and other advantages described herein.)

A detent spring 84 is provided having two legs 86, 88 connected at an end by a spring base 90. The spring base 90 is suitably secured to the handle body solid portion 40, as by a rivet-type shaft 92 extending from the solid portion 40 through an opening 94 in the spring base 90 and then deformed (see FIG. 2) to secure the spring 84 thereto.

Figure 5:
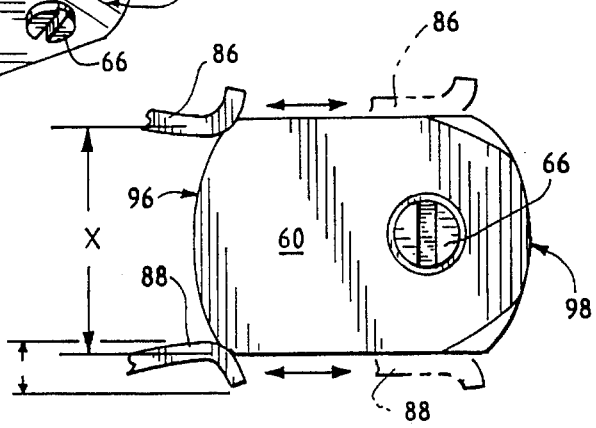
FIG. 5 is a plan view showing the interaction of the handle base and detent spring.

The detent 60 is preferably configured as shown in FIG. 5, with a tapered end 96 and an opposite end 98. The spring legs 86, 88 are biased together so that, in a normal condition, their ends are spaced apart less than the width X of the detent tapered end 96 (which itself is narrower than the width of the central portion of the base 50). Further, the width X of the detent tapered end 96 is less than the total width of the body recess 30 by approximately the combined width of the spring ends. As shown in FIG. 5, the spring legs 86, 88 are, in the preferred embodiment, bent outwardly to define a selected spring end width Y (see FIG. 5). Accordingly, the side walls 32, 34 defining the recess 30 are preferably spaced apart approximately X+2Y.

It should also be appreciated that, by making the detent 60 narrower than the base central portion, the overall width of the handle 10 can be minimized, with the attendant advantages of such minimal size as previously noted.

Operation of the handle 10 is thus as follows.

When the handle 10 is to be moved into the storage position, the legs 86, 88 of the spring 84 are spread from the position shown at left in FIG. 5 to allow the detent 60 to pass therebetween. Once the handle body 16 is in the storage position relative to the base 30 (as shown in FIGS. 1 and 2), the ends of the spring legs 86, 88 will extend toward the detent opposite end 98 and, by their spring force, be biased against the sides of the detent 60 to frictionally secure the legs 86, 88 against the sides of the detent 60 as shown at right in FIG. 5.

Thereafter, once turning of the handle 10 is completed to control the window operator as desired, the handle 10 can be pushed down toward its storage position, the force of which will overcome the friction force between the spring legs 86, 88 and the sides of the detent 60 to allow pivoting of the handle body 16 back to the storage position.

It should be appreciated that, as shown in FIG. 5, the preferred orientation of the detent 60 is such that the slope of the detent tapered end 96 is relatively sharp, with the result being that a significant force will be required (to force the ends of the spring legs 86, 88 apart) in order to pivot the handle body 16 relative to the base 50 when moving from the operable position. Such operation is, of course, preferred, since the handle 10 encounters significant manual forces during turning, and it is important that the handle body 16 be prevented from inadvertently folding up into its storage position during turning, since such accidental folding could cause the user to hurt themselves and/or damage the handle, window, and/or operator.

It should thus now be appreciated that the above described handle 10 will be both strong and durable over many years of use. Such handle 10 will also be easy to install or replace (in both new and existing installations). Moreover, the handle 10 is simple to use. The handle 10 further protects against unrecognized accidental or inadvertent opening and/or unlocking of the window (by allowing the handle 10 to be stored in a position which will minimize its susceptibility to accidental bumping). Still further, the handle 10 minimizes the risk of damage, whether to the handle 10 itself or to the user or to the surrounding window, in both its storage and its operable positions. Advantageously, all of this is accomplished with a handle which may be made aesthetically pleasing while also providing minimal visual intrusion on the window opening with which it is used.

Still other aspects, objects, and advantages of the present invention can be obtained from a study of the specification, the drawings, and the appended claims.

I claim:

1. A handle securable to a window operator drive shaft for selectively manually pivoting said operator drive shaft, said handle being foldable between an operable position for manual pivoting and a storage position, said handle comprising:

a handle body having two ends with a manually graspable portion at one end and a recess in its other end;

a handle base including a cylindrical portion extending in a longitudinal direction and having a central bore extending completely through said base;

means for securing a window operator drive shaft in said cylindrical portion central bore with an outer end of the drive shaft substantially adjacent the handle body when the handle is in a storage position;

means secured to one side of the cylindrical portion for securing the handle base for pivoting relative to the handle body about an axis substantially orthogonal to said longitudinal direction whereby in said storage position said base is substantially within said handle body recess; and a detent releasably securing said handle base relative to said handle body when said handle is in its operable position and when said handle is in its storage position.

2. A handle securable to a window operator drive shaft for selectively manually pivoting said operator drive shaft, said handle being foldable between an operable position for manual pivoting and a storage position, said handle comprising:

a handle body having two ends with a manually graspable portion at one end and a recess in its other end, said recess being defined by body side walls spaced a selected width, a body top wall, and a body end wall at said other body end oriented substantially parallel to the operator drive shaft when the handle is in the operable position;

a handle base including a cylindrical portion extending in a longitudinal direction and having an outer diameter slightly less than said selected width;

means for securing a window operator drive shaft in said cylindrical portion;

means secured to one side of the cylindrical portion for securing the handle base for pivoting relative to the handle body about an axis substantially orthogonal to said longitudinal direction, said body top wall serving as a stop for pivoting of the base relative to the body when the handle is pivoted to the storage position and said wall at one end serving as a stop for pivoting of the base relative to the body when the handle is pivoted to the operable position;

a detent releasably securing said handle base relative to said handle body when said handle is in its operable position and when said handle is in its storage position.

3. A handle securable to a window operator drive shaft for selectively manually pivoting said operator drive shaft, said handle being foldable between an operable position for manual pivoting and a storage position, said handle comprising:

a handle body having two ends with a manually graspable portion at one end and a recess in its other end, said recess being defined by body side walls spaced a selected width, a body top wall, and an end wall at one recess end oriented substantially parallel to the operator drive shaft when the handle is in the operable position;

a handle base including a cylindrical portion extending in a longitudinal direction and having an outer diameter slightly less than said selected width;

means for securing a window operator drive shaft in said cylindrical portion;

means secured to one side of the cylindrical portion for securing the handle base for pivoting relative to the handle body about an axis substantially orthogonal to said longitudinal direction, said body top wall serving as a stop for pivoting of the base relative to the body when the handle is pivoted to the storage position and said wall at one end serving as a stop for pivoting of the base relative to the body when the handle is pivoted to the operable position;

a detent releasably securing said handle base relative to said handle body when said handle is in either its operable position or its storage position, wherein said detent comprises:

a detent portion secured to one of the body or base at an end of the recess opposite the one recess end, said detent portion being narrower than the recess selected width by a selected amount and having a tapered end;

a detent spring fixed to the other of the body or base, said spring having an engaging portion having a width less than said selected amount and engaging said detent portion tapered end when the handle is in the operable position; and means for biasing said engaging portion of said spring around said detent portion tapered end when the handle is manually biased from its operable position toward its storage position.

4. The handle of claim 3, wherein:

said detent spring has two legs connected at one end by a spring base and in an unbiased position spaced apart less than the width of the detent portion; and the other ends of the legs have a total width which is less than the selected amount and comprise the engaging portion of the spring.

5. The handle of claim 4, wherein said detent portion is on a side of the cylindrical portion opposite said one side of the cylindrical portion, and said spring is secured at its base in said handle body recess with said leg other ends abutting the detent portion tapered end when the handle is in its operable position.

6. A handle securable to a window operator drive shaft for selectively manually pivoting said operator drive shaft, said handle being foldable between an operable position for manual pivoting and a storage position, said handle comprising:

a handle body having two ends with a manually graspable portion at one end and a recess in its other end, said recess being defined by body side walls spaced a selected width, a body top wall, and an end wall at one recess end oriented substantially parallel to the operator drive shaft when the handle is in the operable position;

a handle base including a cylindrical portion extending in a longitudinal direction and having an outer diameter slightly less than said selected width;

means for securing a window operator drive shaft in said cylindrical portion;

means secured to one side of the cylindrical portion for securing the handle base for pivoting relative to the handle body about an axis substantially orthogonal to said longitudinal direction, said body top wall serving as a stop for pivoting of the base relative to the body when the handle is pivoted to the storage position and said wall at one end serving as a stop for pivoting of the base relative to the body when the handle is pivoted to the operable position; and a detent releasably securing said handle base relative to said handle body when said handle is in its operable position or its storage position, wherein said detent includes a detent portion secured to one of the body or base at an end of the recess opposite the one recess end, said detent portion being narrower than the recess selected width by a selected amount and having a tapered end, a detent spring fixed to the other of the body or base, said spring having an engaging portion having a width less than said selected amount and engaging said detent portion abutting end when the handle is in the operable position, means defining a taper between the engaging portion of the spring and said detent portion abutting end whereby said taper means causes the engaging portion of the spring to spread clear of the abutting end when said handle is firmly biased from its operable position to its storage position, and means for biasing said engaging portion of said spring around said detent portion tapered end when the handle is manually biased from its operable position toward its storage position.

7. The handle of claim 6, wherein:

said detent spring has two legs at one end defining said engaging portion and at their other end connected by a spring base; and said spring one ends have a total width which is less than the selected amount and are spaced apart less than the width of the detent portion when in an unbiased position.

8. A handle securable to a drive shaft of a window operator for selectively manually pivoting said operator drive shaft, said handle being foldable between an operable position for manual pivoting and a storage position, said handle comprising:

a handle body with a manually graspable portion at one end and a recess of a selected width in said other end;

a handle base including a main body portion having a width slightly less than said selected width, one end of said main body portion having a drive shaft bore completely therethrough and the other end having a pivot bore therethrough substantially orthogonal to said drive shaft bore, and a detent on said main body portion one end, said detent being narrower than the selected width by a selected amount and having a tapered end;

means for securing a window operator drive shaft in said base drive shaft bore;

means for pivotally securing the handle body to the handle base main body portion pivot bore whereby in said storage position said base is substantially within said handle body recess;

a generally U-shaped detent spring having two legs connected at one end by a spring base, the other ends of said legs in an unbiased spring position spaced apart less than the width of the detent, and the other ends of each of said legs having a total width which is less than the selected amount; and means for securing said spring at its base in said handle body recess with said leg other ends abutting the detent tapered end when the handle is in its operable position.

* * * * *